US009633583B2

(12) United States Patent
Cobb et al.

(10) Patent No.: US 9,633,583 B2
(45) Date of Patent: Apr. 25, 2017

(54) LOW PROFILE, SELF-ALIGNING CUSTOMIZABLE SIGN AND METHOD OF DISPLAYING CUSTOMIZABLE INFORMATION

(71) Applicant: APCO Graphics, Inc., Atlanta, GA (US)

(72) Inventors: Jeffrey B. Cobb, Atlanta, GA (US); Dillon P. Cobb, Atlanta, GA (US); Benjamin H. Bell, Avondale Estates, GA (US); Daniel L. Roberts, Lawrenceville, GA (US)

(73) Assignee: APCO Graphics, Inc., Atlanta, GA (US)

( * ) Notice: Subject to any disclaimer, the term of this patent is extended or adjusted under 35 U.S.C. 154(b) by 14 days.

(21) Appl. No.: 14/750,774

(22) Filed: Jun. 25, 2015

(65) Prior Publication Data

US 2016/0379531 A1 Dec. 29, 2016

(51) Int. Cl.

| | |
|---|---|
| ***G09F 17/00*** | (2006.01) |
| ***G09F 7/20*** | (2006.01) |
| ***G09F 7/08*** | (2006.01) |
| *G09F 7/18* | (2006.01) |

(52) U.S. Cl.
CPC ..... *G09F 7/20* (2013.01); *G09F 7/08* (2013.01); *G09F 2007/1856* (2013.01)

(58) Field of Classification Search
CPC ..... G09F 7/18; G09F 15/0012; G09F 2007/1843; G09F 2007/1856; G09F 7/10; G09F 15/0068; G09F 1/12; G09F 15/0025; G09F 15/0018; G09F 15/00; G09F 1/10; G09F 3/18; G09F 21/048; G09F 7/20
USPC ..... 40/611.05
See application file for complete search history.

(56) References Cited

U.S. PATENT DOCUMENTS

| | | | | | |
|---|---|---|---|---|---|
| 3,601,917 | A * | 8/1971 | Shankman | G09F 7/12 | 40/622 |
| 3,824,722 | A * | 7/1974 | Maruscak | G09F 7/08 | 40/585 |
| 3,982,345 | A * | 9/1976 | Coleman | G09F 13/04 | 160/378 |
| 4,265,039 | A * | 5/1981 | Brooks | G09F 13/04 | 160/395 |
| 4,344,244 | A * | 8/1982 | Tyke | G09F 7/02 | 40/490 |
| 4,937,961 | A * | 7/1990 | Gandy | G09F 15/0025 | 160/378 |
| 4,955,928 | A * | 9/1990 | Tanner | G09F 15/02 | 160/354 |

(Continued)

*Primary Examiner* — Shin Kim
(74) *Attorney, Agent, or Firm* — Fisher Broyles, LLP; Rachel H. Huffstetler

(57) ABSTRACT

A sign assembly have a chassis assembly for supporting indicia plates and for providing proper horizontal alignment of the indicia plates. The chassis assembly includes two chassis members having a medial receptacle for receipt of a support panel and a receptacle for receipt of alignment members. The indicia plates include mating members on distal edges for cooperating with the chassis member alignment members. The mating members and alignment members have cooperating surface configurations to facilitate proper indicia plate horizontal alignment. A tamper resistant assembly prevents unintentional removal of the indicia plates from the chassis assembly.

39 Claims, 10 Drawing Sheets

(56) References Cited

U.S. PATENT DOCUMENTS 5,189,822 A * 3/1993 Schmanski ..... G09F 7/10 248/551
5,207,011 A * 5/1993 Coulthard ..... G09F 7/12 40/568
5,255,459 A * 10/1993 Verret ..... G09F 15/0025 40/563
5,398,388 A * 3/1995 Coleman ..... G09F 15/0025 24/462
5,517,779 A * 5/1996 Coleman ..... G09F 15/0012 160/328
5,572,821 A * 11/1996 Coleman ..... G09F 15/0025 160/328
5,588,238 A * 12/1996 Visocky ..... G09F 7/10 40/575
5,678,338 A * 10/1997 Coleman ..... G09F 15/0025 40/572
5,893,227 A * 4/1999 Johansson ..... G09F 15/0025 160/328
6,088,942 A * 7/2000 Brooks ..... G09F 15/0025 160/328
6,637,080 B2 * 10/2003 Verret ..... G09F 1/12 16/87.2
7,055,275 B1 * 6/2006 Teza ..... A47G 1/065 40/674
7,165,296 B2 * 1/2007 Coleman ..... F16B 5/0692 24/462
7,954,267 B2 * 6/2011 Anzalone ..... G09F 7/18 40/611.06
8,033,041 B2 * 10/2011 van Riet ..... G09F 15/0025 248/560
8,347,939 B2 * 1/2013 Brabeck ..... E06B 9/52 160/371
8,702,051 B2 * 4/2014 Vanham ..... F16B 5/0692 248/477
D724,153 S * 3/2015 Sacks ..... D20/44
9,228,600 B2 * 1/2016 Frey ..... G09F 15/0018
9,284,770 B2 * 3/2016 Sprague ..... E06B 3/308
2004/0068904 A1 * 4/2004 Burrous ..... G09F 15/0018 40/611.01
2004/0194361 A1 * 10/2004 Furlan ..... G09F 15/00 40/601
2012/0272553 A1 * 11/2012 Bell ..... G09F 15/00 40/611.07
2013/0263486 A1 * 10/2013 Logan ..... G09F 7/18 40/607.13
2014/0109448 A1 * 4/2014 Lehrkamp ..... G09F 15/0012 40/606.09
2016/0012757 A1 * 1/2016 Logan ..... G09F 7/18 40/600

* cited by examiner

LOW PROFILE, SELF-ALIGNING CUSTOMIZABLE SIGN AND METHOD OF DISPLAYING CUSTOMIZABLE INFORMATION

FIELD OF THE INVENTION

The present invention is directed to a customizable sign assembly in the form of a mountable sign and a method of securely displaying interchangeable information, generally, and, more specifically, to a low profile sign assembly to display selective information in a tamper resistant and visually appealing manner.

BACKGROUND OF THE INVENTION

It is desirable for architectural signs to have customizable and/or interchangeable information displayed. Such signs are placed on structures, such as buildings, either on its exterior or interior, or are self-standing. Signs are used to display a variety of information, such as way finding and identification information. As used herein, "signs" refers to any sign conveying information including, for example, identification signs, regulatory signs, information signs and directional signs. These signs may provide a single informational message or may provide more than one informational message.

Customizable signs are often manufactured and are customized by providing interchangeable informational indicia depending upon the information to be displayed. It is desirable to also provide a sign assembly wherein the informational indicia may be interchanged while also preventing unwanted tampering of the sign assembly. Prior art mechanical signs include interchangeable indicia displays in the form of plates which are mechanically or magnetically secured to a frame. For example, U.S. Pat. No. 3,824,722 is representative of a conventional display sign including hanging indicia plates positioned on a frame and having a clear cabinet front. A shortcoming of these type of displays, however, is that they have large and obtrusive profiles which may be undesirable in many settings, such as passageways, and not visually appealing. Other signs include metallic frames for receiving magnetic display plates. Such systems, however, lack the ability to ensure proper alignment of the various indicia displays and the overall appearances may be negatively impacted. A shortcoming of these prior art interchangeable signs, however, is that much care must be used to ensure that the informational indicia applied to the sign by the user is done so in a correct manner wherein the informational indicia are readily aligned. Another shortcoming of the prior art sign systems is that such systems may be bulky and, therefore, not visually appealing in all settings, particularly in interior passageways. The integrity of sign systems must also be considered to prevent unintentional alteration of the display and to also prevent intentional tampering of the sign system, such as the removal or rearrangement of any information display positioned on the sign, or the sign itself. These and other objectives are met by the present invention.

SUMMARY OF THE INVENTION

In accordance with preferred embodiments of the present invention, the present invention obviates shortcomings of the prior art by providing a low profile, sell-aligning, and tamper resistant sign assembly. These and other objectives are met by the present invention which is directed to a sign assembly which may be mounted to an architectural structure for displaying customizable information such as identification and way finding. The sign assembly includes a chassis assembly and an indicia display assembly.

The chassis assembly supports the indicia display assembly and includes at least one or more side chassis members and a support panel extending there between. According to one aspect of the invention, the support panels is removably received within a medial receptacle defined by each chassis member to provide customizable dimensions. According to another aspect of the invention, the support panel is integral with the chassis members, such as for standardized frame dimensions. Each chassis member includes an additional receptacle for receipt of an alignment member. The receptacle for receipt of the alignment member preferably is a channel and defines a distal channel of a first chassis member and an intermediate channel of a second chassis member. The alignment member according to one aspect of the invention is an alignment guide having a front surface defining tines or ribs and indentations having predetermined dimensions, for example, equidistantly positioned tines or ribs. The chassis assembly provides a low-profile sign assembly wherein the chassis assembly is obscured from view when the sign assembly is assembled.

The indicia display assembly includes at least one or more indicia plates which bear the information to be displayed. Each indicia plate includes at least one, and preferably two, mating members on opposing distal ends mounted on a rear surface thereof. The mating members include a mating flange on the distal end and which define alignment contacts on a rear surface for cooperating with the alignment guide mating surface positioned within the chassis members. The mating members also include a locking flange for cooperating with either the intermediate or distal receptacles of the respective chassis member. According to another aspect of the present invention, a positioning member or locator may be utilized to facilitate positioning of at least one indicia plate. The novel configuration of the mating member and alignment guides facilitates assembly of the indicia plates wherein the indicia plates will be in horizontal alignment.

A tamper resistant assembly including a locking pin is provided to prevent accidental or intentional tampering of the assembled sign assembly. The locking pin is inserted into one of the channels of at least one chassis member so as to diminish the clearance between the mating member and the chassis member and to secure the connection there between. According to a preferred aspect of the present invention, the locking pin is positioned within the distal channel of one of the chassis members.

The method includes assembling the chassis assembly and the indicia display assembly. The mating members are positioned on distal ends of the rear surface of the indicia plates, such as with the assistance of a template. The alignment guides are positioned within respective channels of the first and second chassis members. Alternatively, the alignment guides may be permanently provided within the chassis member. The indicia plate mating members are then positioned on the chassis assembly by applying the mating member flange so as to cooperate with the alignment guide of one chassis member. The other distal end of the indicia plate and its mating member are applied to the alignment guide of the opposing chassis member. Subsequent indicia plates may be similarly applied and the novel configuration of the sign assembly substantially ensures proper alignment of adjacent plates. The indicia plates thereby cover and extend beyond the width and the height of the chassis assembly to present a low-profile, "frameless" appearing sign assembly. The locking pin may then be positioned within a respective chassis member and removed to reassemble the sign assembly.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention.

Figure 1:
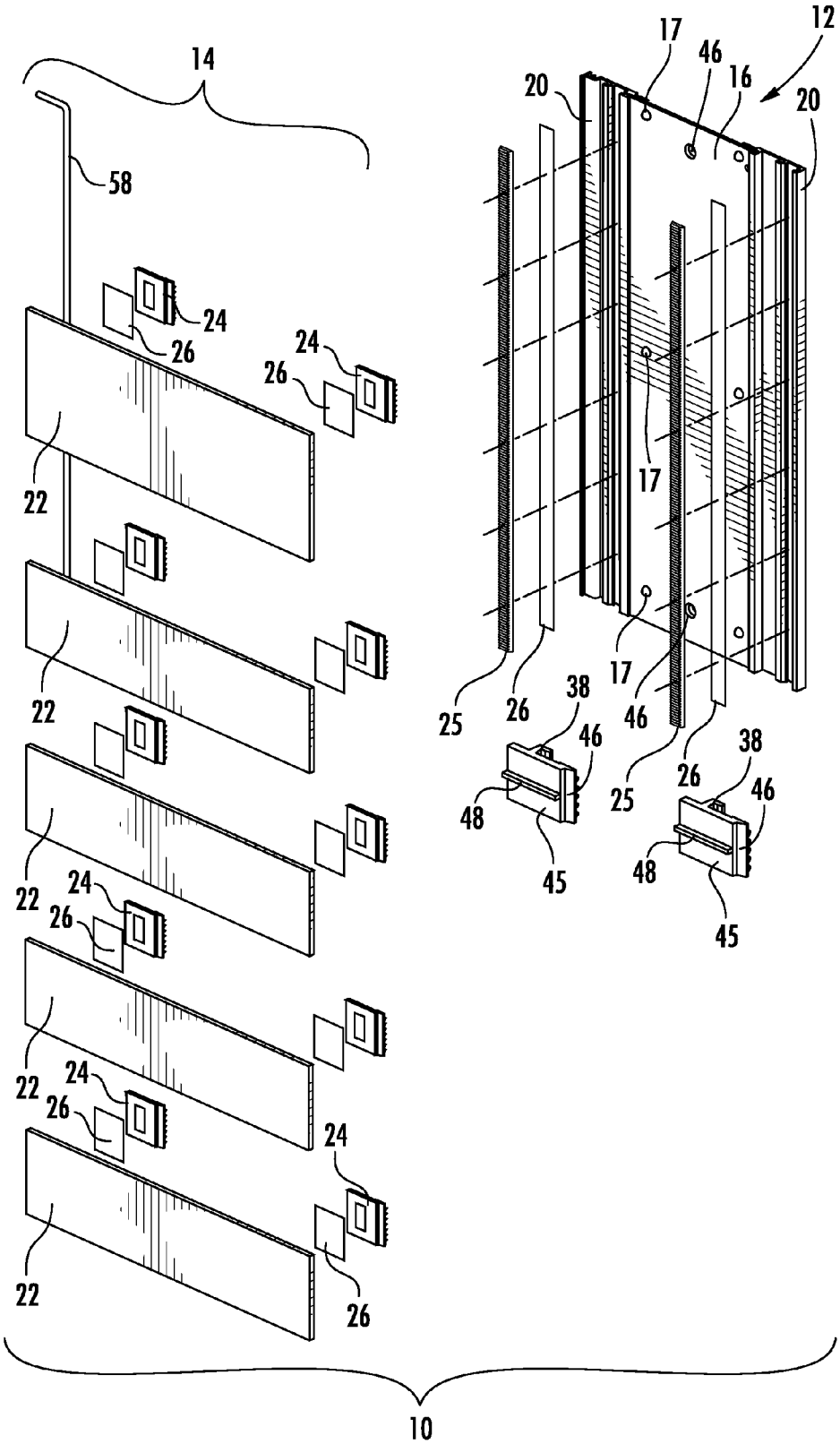
FIG. 1 is an exploded view of the sign assembly according to the present invention.
Figure 2:
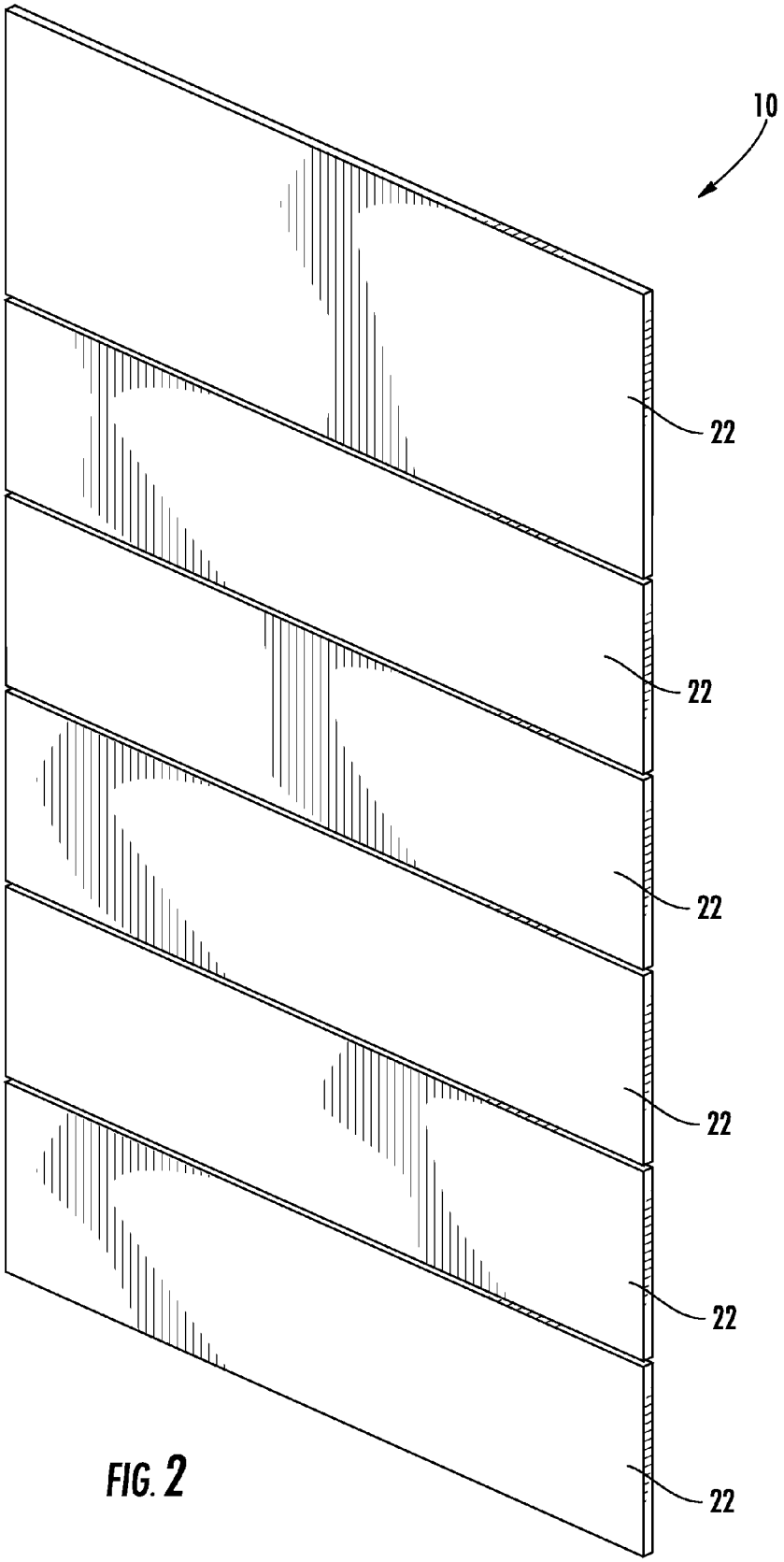
FIG. 2 is an assembled, perspective view thereof.

FIG. 1 depicts the sign assembly 10 in an exploded view and FIG. 2 depicts the sign assembly 10 assembled demonstrating its "frameless" appearance and having a low-profile. Sign assembly 10 includes a chassis assembly 12 and an indicia display assembly 14. According to one aspect shown in FIG. 1, the chassis assembly 12 includes a support panel 16 and chassis members 20. The support panel 16 is secured to the chassis members 20 by at least one, and preferably a plurality of, securing members or rivets 17 as will be more fully described below. Indicia display assembly 14 includes indicia plates 22, mating members 24 for cooperating with alignment guides 25 and means 26 for securing the mating members 24 to the indicia plates 22.

The indicia plates 22 may be formed of any rigid or semi-rigid material. According to one aspect of the present invention, indicia plates 22 are formed of a composite material which may include an aluminum or plastic core and a printable material, such as an extruded plastic material. Accordingly, the extruded, printed layer may be formed with greater dimensions than the rigid or semi-rigid core such that end surface of the printed layer may be wrapped around the edges of the core for a cohesive appearance. According to another aspect of the present invention, the indicia plates are formed of a polymeric material, for example, acrylic, As shown in FIG. 2, once assembled, the sign assembly 10 displays indicia plates 22 in alignment with one another and the sign assembly 10 demonstrates a "frameless" appearance having a low-profile, meaning that it has a substantially flush front face and is relatively thin when measured from the front surface to the rear surface. This results in a low-profile sign assembly mounted as an architectural sign to a mounting surface, such as a wall. As shown herein, indicia plates 22 are positioned substantially adjacent one another. However, it is within the scope of the present invention to provide decorative chassis members (not shown) which may be juxtaposition between adjacent plates 22. As illustrated, the width of indicia plates 22 is greater than the width of the assembled chassis assembly 12 and the overall height of the assembled indicia plates 22 (from the top edge of the topmost guide and the bottom edge of the bottommost slide) is greater than the overall height of the assembled chassis assembly 12. This configuration results in a an overhang or reveal of the indicia plates 22 so as to obscure the chassis assembly 12 from immediate view and to create a frameless-appearing sign assembly 10, thereby further facilitating a low-profile structure and appearance.

Figure 3:
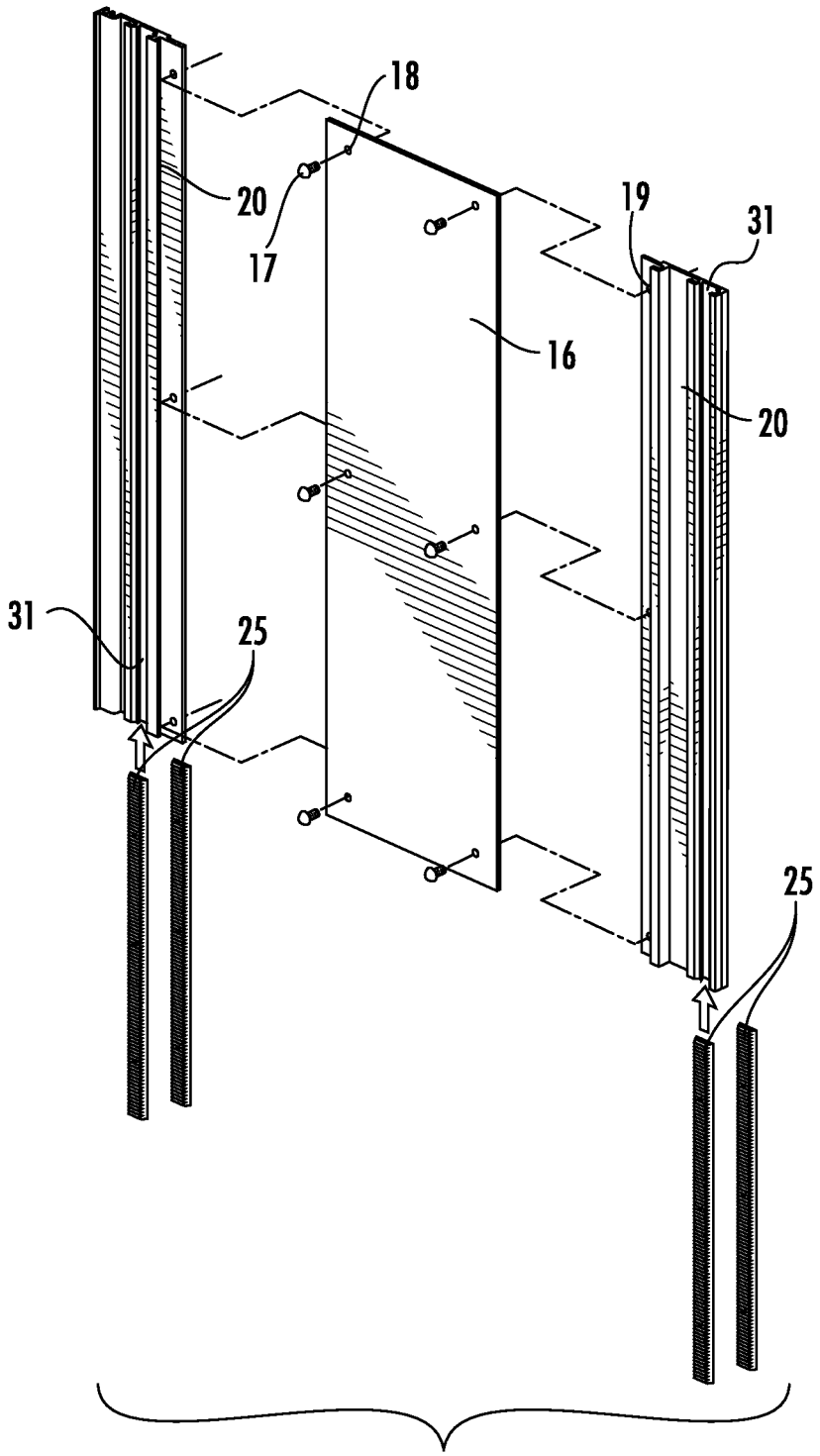
FIG. 3 is an exploded view of the chassis assembly of the sign assembly.

The chassis assembly 12 will now be described in detail with reference to FIGS. 3-5. At least one chassis member 20, and preferably a pair (or more) of chassis members 20, is/are provided and configured to receive at least one alignment guide 25 and support panel 16. As shown in FIG. 3, first and second chassis members 20 are positioned on opposing sides of the sign assembly 10. Each chassis member 20 includes receptacle, for example a channel, for receipt of a rear supporting panel 16 and a receptacle, for example a channel, for receiving at least one alignment guide 25. According to one aspect of the present invention shown in FIG. 1, for example, the alignment guides 25 are positioned within the channels 31 from the channel 31 open faces. As shown, one alignment guide 25 having a longitudinal length substantially equal to the channel 31 length is positioned within each channel 31. The alignment guides 25 are then secured such as by an adhesive foam tape 26. Alternatively, more than one guide 25 may be inserted within the channels 31 and plural guides may be positioned with a predetermined space there between (not shown). As exemplified in FIG. 3, two guides 25 are provided. Such is apparent to one of ordinary skill in the art. Another aspect of the invention pertains to alignment guides 25 which may alternatively be inserted from a bottom open surface of the channels 31 as shown in FIG. 3, for example. The description which follows applies, generally, to all aspects of the present invention.

Figure 4:
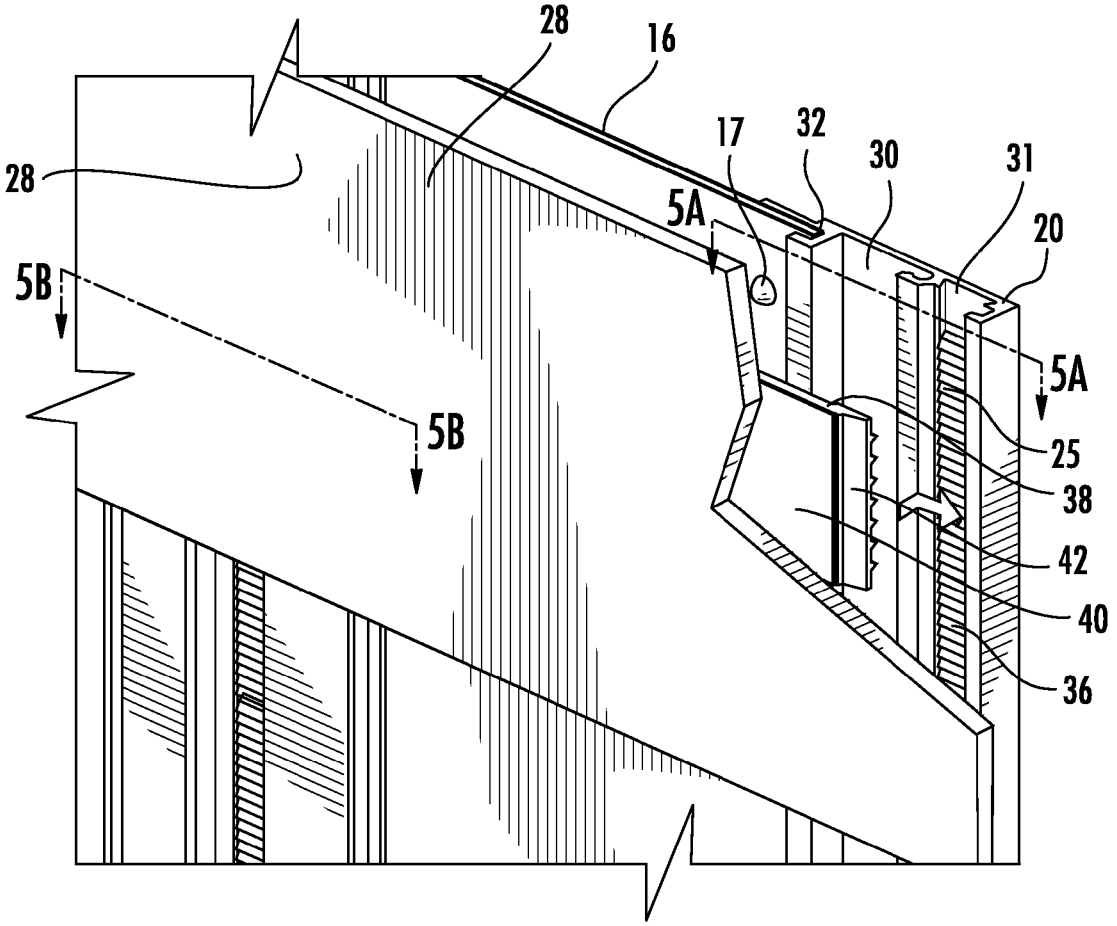
FIG. 4 is an enlarged, partially broken away, view of the alignment assembly.
Figure 5A:
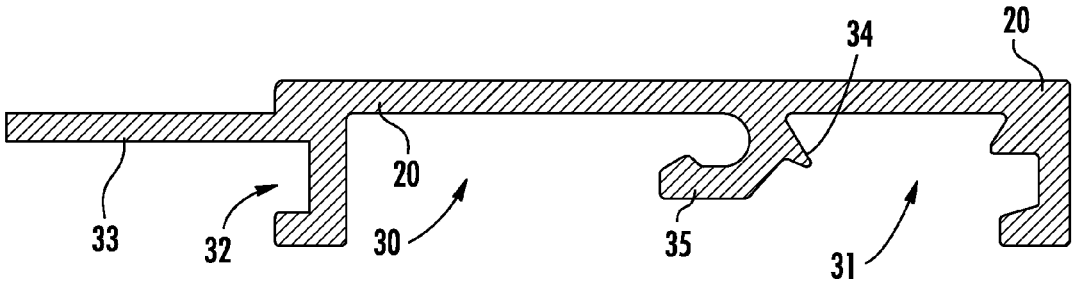
FIG. 5A is a cross-sectional view of the sign chassis taken along line 5A-5A of FIG. 4.

FIG. 5A depicts a cross-sectional view of a first chassis member 20 configuration taken along line 5A-5A in FIG. 4. The chassis member 20 shown in FIG. 5A (which does not include a tamper resistant assembly described below) defines a distal receptacle or channel 30 for selectively receiving an alignment guide 25 and a locking flange 42 of the mating member 24, a medial receptacle 32 configured for receipt of the support panel 16 and having a securing flange 33 for securing to the support panel 16, and an intermediate member, shown in the form of an intermediate receptacle or channel 31, for receipt of the mating member flange 38, as will be described below in reference to various Figures.

Figure 5B:
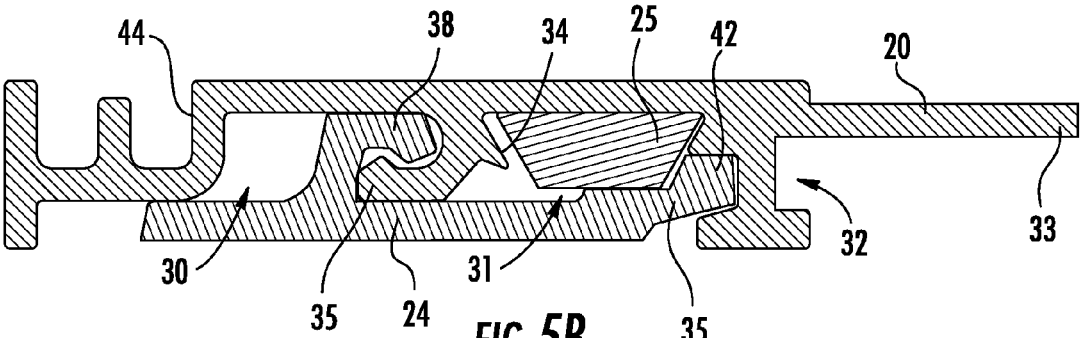
FIG. 5B is a cross-sectional view of the sign chassis taken along line 5B-5B of FIG. 4 according to one aspect of the present invention (with the rear surface panel removed)
Figure 9:
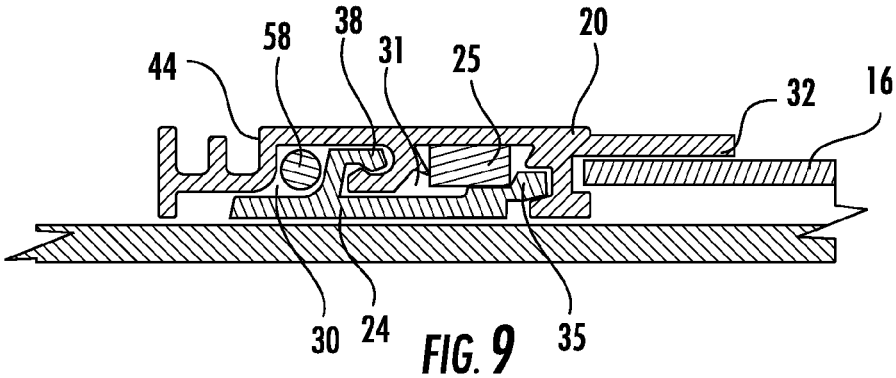
FIG. 9 is a cross sectional view of the locking system taken along line 9-9 of FIG. 8.
Figure 10:
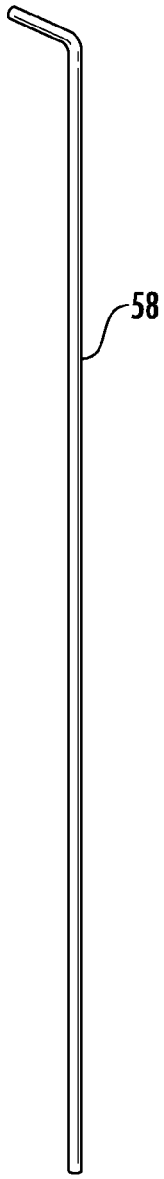
FIG. 10 is a locking tool.

FIGS. 5B and 9 depict a cross-sectional view of the second chassis member 20 including a tamper resistant assembly for securing the assembled indicia plates 22. The second chassis member 20 further includes a securing flange 44 for creating a contact surface within the distal channel 30 to cooperate with the tamper resistant assembly described below. As shown in FIG. 5B, the chassis member 20 includes a medial receptacle or channel 32 for receiving the support panel 16. An intermediate receptacle or channel 31 defines a flange 35 for matingly engaging the flange 38 of the mating member 24 when the mating member is positioned within the intermediate channel 31. The second chassis member 20 also includes a medial channel 32 having an inwardly extending flange 33 for cooperating with the support panel 16.

Figure 5C:
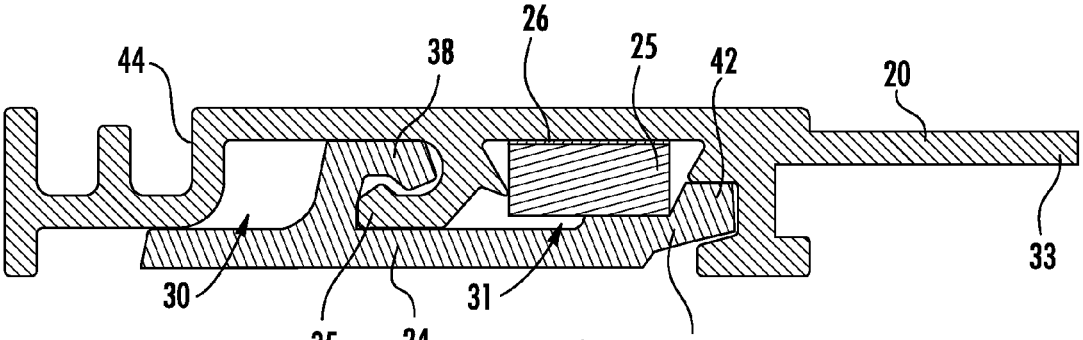
FIG. 5C is a cross-sectional view of the sign chassis taken along line 5B-5B of FIG. 4 according to another aspect of the present invention (with the rear surface panel removed)

FIG. 5C is illustrative of another aspect of the alignment guide 25 which includes a substantially quadrilateral profile, such as when the alignment guide 25 is inserted into the front of the channels 31 of the respective chassis member 20. As shown, locking member 24 is provided, but may alternatively be omitted if the alignment guide is otherwise secured in position along the length of the channel 31 such as be an adhesive tape 26 shown in FIG. 1.

Preferably, one of each the first and second chassis members 20 are provided, but it is not a departure from the scope of the present invention to provide two first chassis members 20 or two second chassis members depending, for example, upon the degree of tamper resistance desired. Moreover, it is within the scope of the present invention to provide the chassis member 20 having the tamper resistant means on the right side of the sign assembly rather than the left, one neither chassis member 20, or on both chassis members.

At least one chassis member 20 and, preferably each chassis member 20, includes a plurality of alignment guides 25 to position the indicia plates 22 on the sign assembly 10 so as to be properly aligned with each other. As shown, three alignment guides 25 are provided for each chassis member 20, but a single guide extending substantially the length of the chassis member 20 or a portion thereof is within the scope of the present invention. Any number of slides 25 may be provided depending upon manufacturing constraints and/or the size and number of indicia plates 22 to be displayed. Additionally, spaced apart slides may also be provided. In operation, the alignment guides 25 are positioned within the distal channel 30 of the chassis members 20 either from the bottom, as shown, or the top. The alignment guides 25 may then move, or slide, along the length of the distal channel 30 until properly positioned.

Alignment guides 25 include a substantially flat rear surface which contacts, and may guide along the length of, the interior of the distal channel 30 of the chassis members 20. The opposing, or front surface, of the alignment guides 25 define tines or teeth 36 defining indentations between adjacent teeth. Once positioned, the locking member 34 may be depressed by a conventional tool (not shown) to cooperate with the teeth of the alignment guide 25 and secure its position. According to one aspect of the invention, however, the alignment guides 25 may be properly positioned by an adhesive member 26 and the need to secure its position by the locking member 34 is obviated. Accordingly, this member 34 may not be present.

Figure 11:
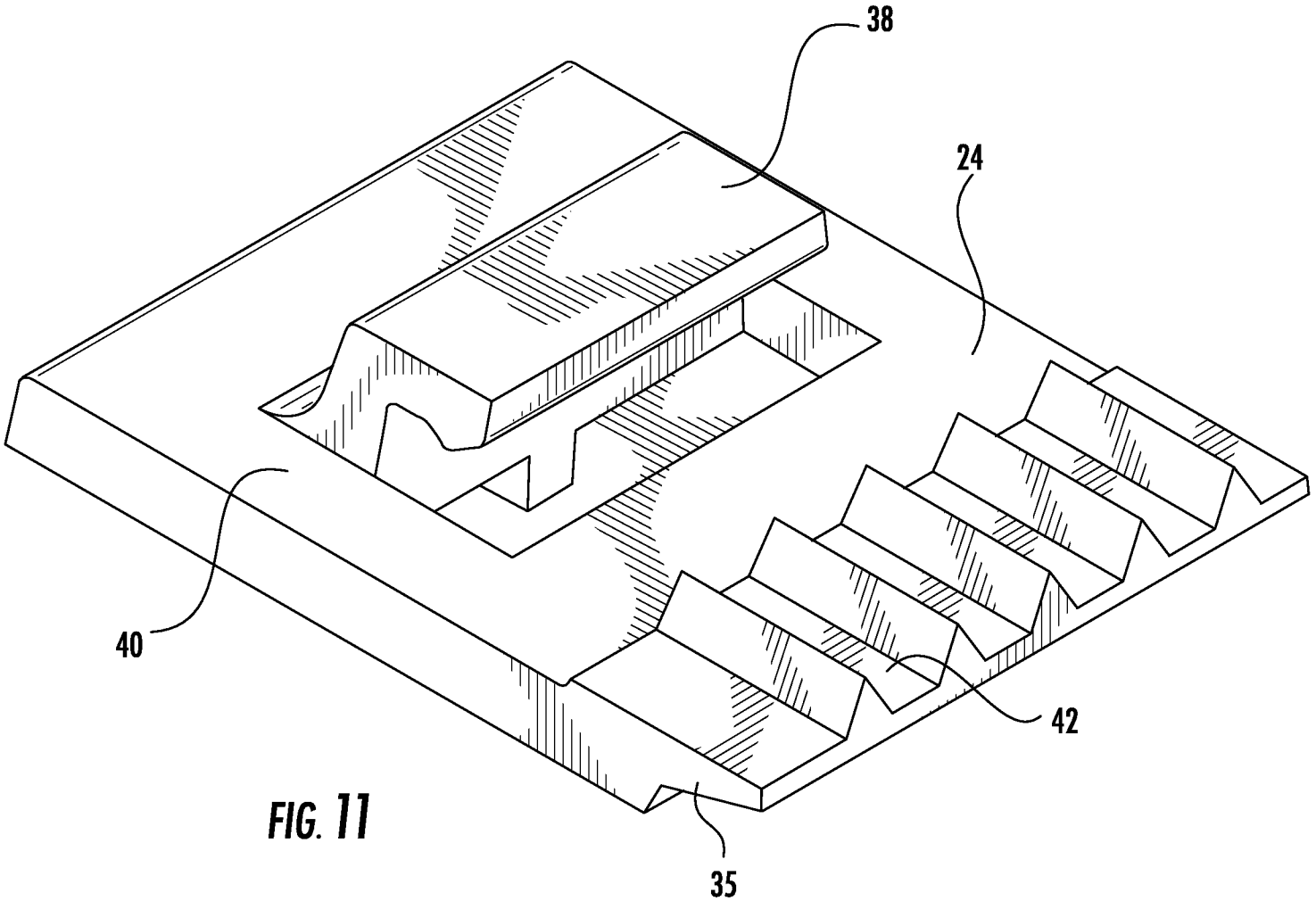
FIG. 11 is an enlarged perspective view of the mating member.

Each indicia plate 22 includes a mating member 24 on distal sides thereof. At least one of the mating members 24, and preferably both, include a main body 40, a mating flange 38 and a locking flange 42 as best shown in FIGS. 4 and 11. The mating member flange 38 cooperates with the chassis member mating flange 35 of the chassis member 20. As to the first chassis member 20, the mating flange 38 is defined by the intermediate channel 32. As to the second chassis member, the mating flange 38 is defined by the distal channel 30. The mating member flange 38 is preferably formed of a material having an inherent degree of flexibility wherein mating member flange 38 may be pressure fitted into the corresponding side member channel when the indicia plate is placed on the chassis assembly 12. The locking flange 42 comprises at least one, and preferably several, projections or teeth which are correspondingly sized to the alignment guide teeth 36 so as to matingly engage one another. The mating teeth of the mating member 24 and the alignment guides 25 prevent relative longitudinal movement of one relative to the other along the length the of the chassis members 20. The dimensions of the teeth are selected based upon the relative size of the indicia plates 22 and sign assembly 10, generally.

According to an exemplary sign assembly, by way of example, the width between adjacent teeth corresponds with a particular size of the indicia plates 22. For example, for a roughly 12" sign assembly, the teeth may be selected to be about 1/16" on center and the indicia plates will selectively have 1/16" between adjacent plates. Alternatively, the plates may be positioned flushed to one another. The smaller the teeth of the various members, the more precise the spacing. This unique configuration and unique placement of the alignment guides ensures a positive vertical alignment of and proper spacing between indicia plates 22.

Figure 6B:
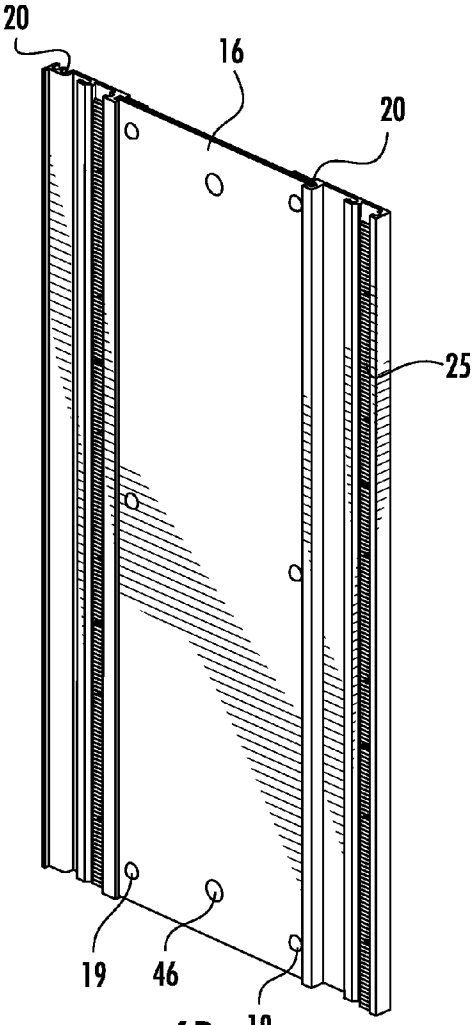
FIG. 6B is an assembled view of the chassis assembly of the sign assembly of FIG. 6A.
Figure 6A:
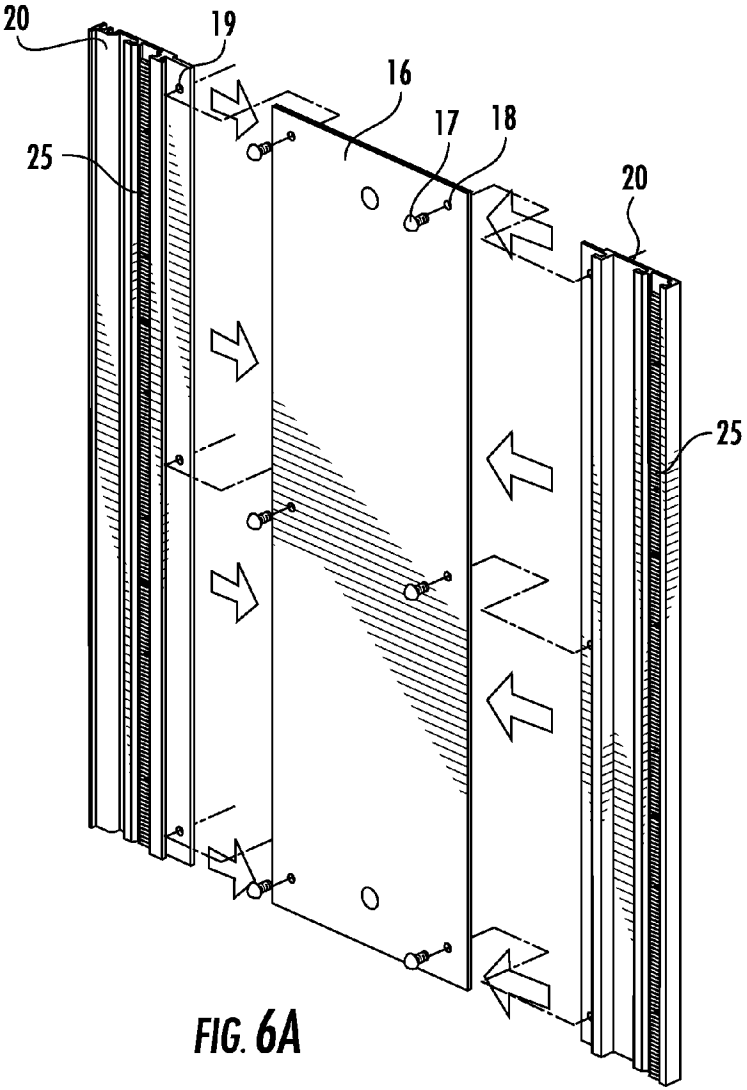
FIG. 6A is a partially exploded view of the chassis assembly of the sign assembly according to one aspect of the present invention.

One aspect of the chassis assembly 12 is shown in FIGS. 1, 6A and 6B. The chassis assembly 12 includes a pair of chassis members (at least) 20 which are positioned on opposing sides of the support panel 16. At least one, preferably two, and more preferably, a plurality of securing members, such as rivets 17, are provided. The rivets 17, as shown, are configured to be received within apertures 18 on the support panel 16 and apertures 19 located on the securing flange 33 of the side panels 20. This configuration facilitates the insertion of the support panel 16 within the medial channels 32 of each side member 20. The support panel 16 is then secured to the securing flanges 33 by the application of at least one or more rivets 17. As shown in FIG. 4, a rear outer panel 28 may be provided so as to define a flat mounting surface of the sign assembly 10.

Figure 7A:
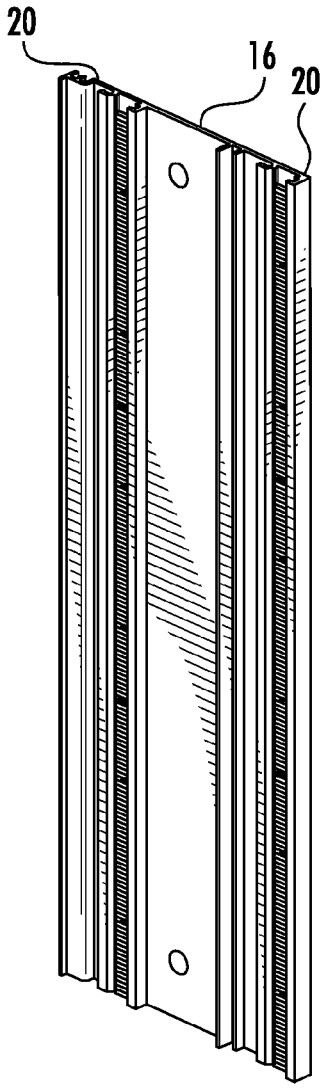
FIG. 7A is an assembled view of the chassis assembly of the sign assembly according to one aspect of the present invention.
Figure 7B:
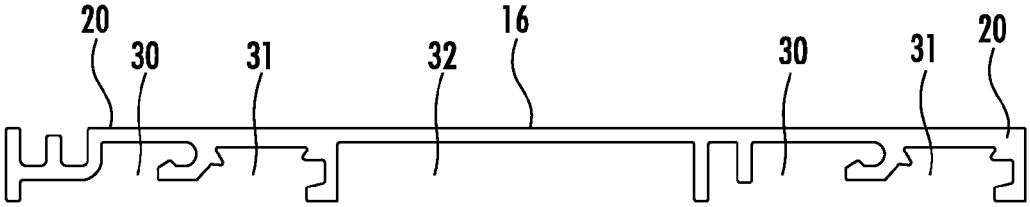
FIG. 7B is a cross-sectional view of the chassis assembly of FIG. 7A.

The chassis assembly 12 shown in FIGS. 7A and 7B illustrates another aspect of the present invention wherein the chassis assembly 12 is substantially a unitary structure for a sign assembly having pre-defined or standard dimensions. As shown in these Figures, the rear panel 16 and frame members 20 are integrally formed. As such, the need for securing members 17, 18 and 19 are obviated. FIG. 7B shows a unitary structure comprised of rear panel portion 16 and frame member portions 20.

As shown, the sign assembly 10 includes a single column of indicia plates 22 having first and second chassis members 20. It is within the scope of the present invention, however, to provide a chassis assembly 12 with more than one column of indicia plates 22 (not shown). Accordingly, one (or more) chassis members 20 may be doubled wherein opposing sides have mirror or reverse configurations to support a support panel 16 on either side thereof. As such, one or more sides of the doubled chassis member may include the tamper resistant assembly.

According to one aspect of the present invention, as shown in FIG. 1, a positioning member or locator 45 may be provided. Positioning member 45 may selectively be utilized to further facilitate proper positioning between adjacent indicia plates 22. Preferably, a pair of positioning members 45 are utilized and are positioned beneath the top-most (or bottom-most if installation begins from the bottom) plate 22. Any number of locators 45 may be provided, but as shown, the pair of locators 45 are positioned beneath the top-most indicia plate 22 and the adjacent indicia plate 22. The locators 45 further facilitate proper alignment of adjacent indicia plates 22 and ensures that subsequently assembled plates 22 will be in horizontal alignment with the already assembled indicia plates 22. The locators 45 are beneficial, for example, when installation of the sign assembly requires the installer to remove the top and/or bottom indicia plates 22 so as to access the mounting members 46. For example, if the top plate 22 is removed, perhaps after the initial installation of the sign assembly, the previously positioned locators 45 facilitates accurate relocation of the removed indicia plate 22.

The locator 45 comprises a front surface defining a guide 48 which, as shown, preferably is a horizontally and outwardly extending flange which is configured to extend between and cooperate with side edges of adjacent indicia plates 22 to provide conformity in spacing after the installation of the first plate. One side edge of the locator 45 includes a mounting flange 48 shown in the form of teeth which are configured to cooperate with the alignment guides 25 positioned within chassis members 20. The teeth 46 are configured as described above with regard to the mating member 24 so as to cooperate with the alignment guides 25 in intermittent positions as defined by the dimensions of the teeth 46 to facilitate alignment. Therefore, the method may further include the step of positioning at least one, or a pair, of locators 45 between adjacent indicia plates 22 to facilitate removal of one or more plates 22 so as to access mounting members or apertures 46 and any securing means positioned therein.

Figure 8:
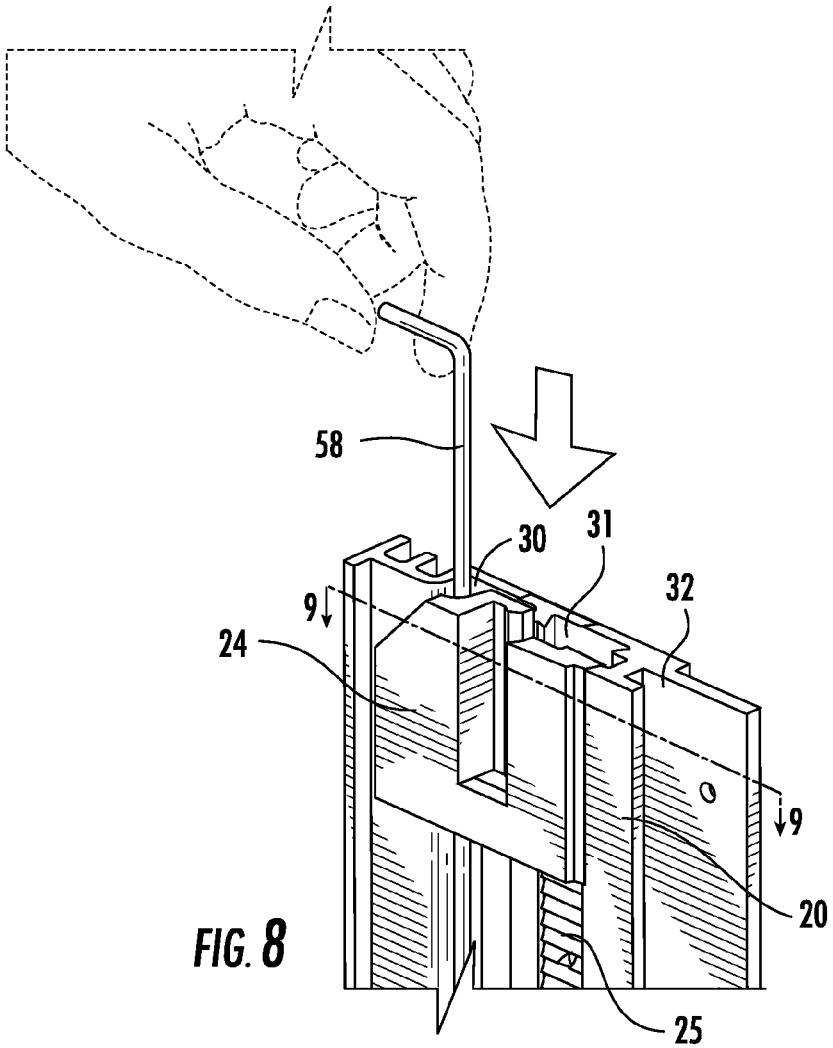
FIG. 8 is a perspective view of the locking system of the sign assembly.

According to the invention shown, one chassis member 20 (left chassis member 20 as shown) includes a locking assembly as in FIG. 8 and the other chassis member (right chassis member 20 as shown) does not, as in FIGS. 5A and 5B. It is within the scope of the present invention, however, to provide both chassis members with locking assemblies or to not provide a locking assembly. If a locking assembly is provided, such as to prevent unintentional alteration of the sign assembly and/or to prevent intentional tampering of the sign assembly, is it preferred to provide one of each chassis members 20, as shown, with the locking assembly on either the right or left chassis member 20. This facilitates continuity in manufacturing wherein similarly configured mating members 24 may be utilized with a chassis member 20 with and without a locking arrangement.

FIG. 9 is a cross-sectional view taken along line 9-9 in FIG. 8. As shown in these Figures, a locking pin 58 is vertically inserted within the distal channel 30 so as to be located between the mating flange 35 of the mating member 24 and the securing flange 44 of the chassis member 20. The insertion of the locking 58 substantially diminishes the clearances between the mating member 24 and the chassis member 20 to prevent removal of the indicia plate 22. As shown, the locking pin 58 extends substantially the entire vertical height of the sign assembly 10, but it may be desired to selectively secure less than all of the indicia plates 22 and provide a shorter locking pin 58. A support panel (not shown) may be provided.

The method of displaying the customizable information includes providing the sign assembly 10 including the chassis assembly 12 and indicia display assembly 14 as described above. The chassis assembly 12 is constructed, in one aspect, by positioning the support panel 16 within the medial channels 32 of the side chassis members 20 and securing the assembly with the rivets 17 positioned within respective apertures 18, 19 and securing the rivets. According to another aspect, these members may be integrally formed. The alignment guide or guides 25 are positioned within a respective channel 31, either from a front surface or from an open lower end.

The support panel 16 may be formed of any suitable material, but preferably, is formed of an aluminum composite material or an extruded plastic. Support panel 16 includes mounting means in the form of at least one, a preferably at least two, mounting members 46. As shown, mounting members comprises at least two apertures for receipt of connection means (not shown) which may be mounted to the supporting surface or surface panel 28 for the sign assembly 10.

The indicia display assembly 14 is assembled by securing at least one, and preferably at least two, mating members 24 to each indicia plate 22. Securing means, such as adhesive members 26, are preferably utilized to secure the mating member to the rear side (opposing the information display side) of the indicia plates 22. Utilizing other securing means would not be a departure from the scope of the present invention.

Figure 12:
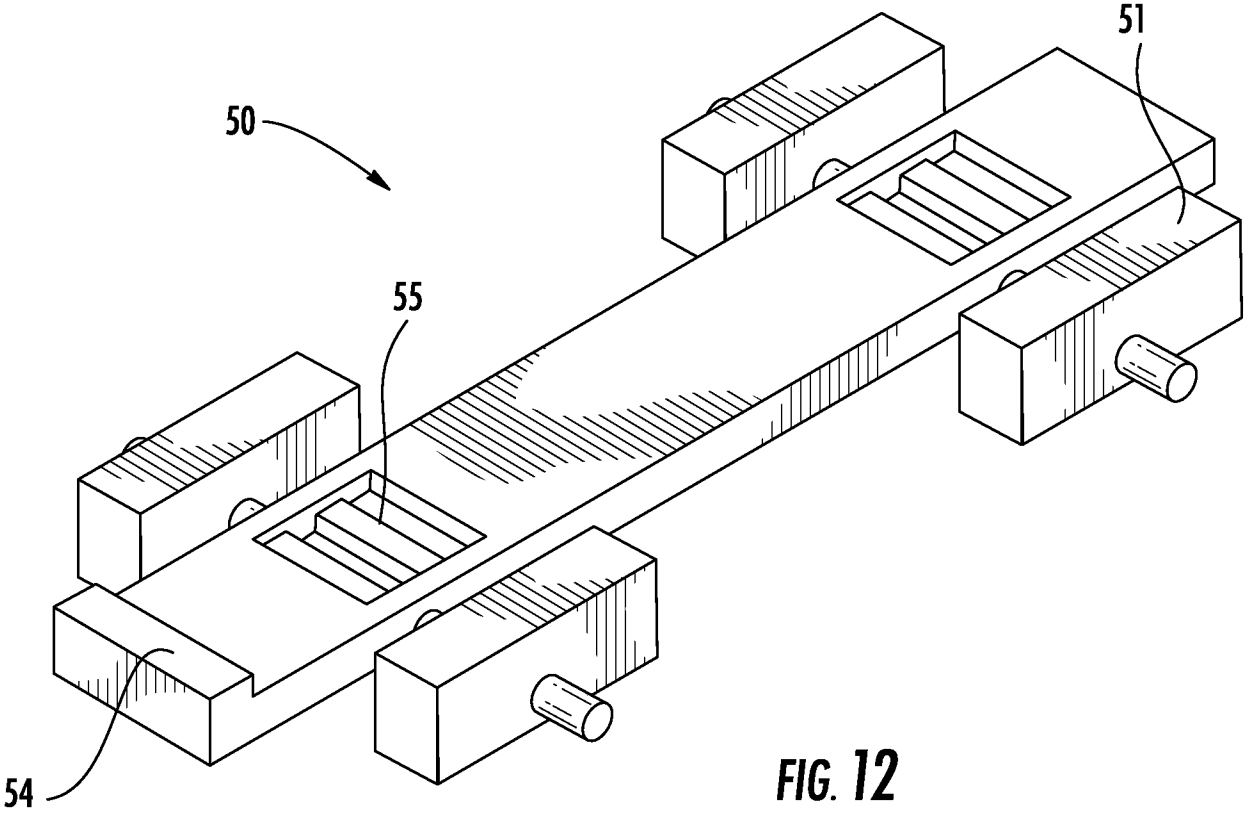
FIG. 12 is an assembling template for the indicia display assembly.

To facilitate proper placement of the mating members 24 and adhesive members 26, a template 50 as shown in FIG. 12 may be provided and is preferable if installation is performed in the field. Template 50 includes a main body 52 and at least one side interface 51 positioned along a side thereof. Preferably, a pair of opposing side interfaces 51 are provided. A second set of opposing side interfaces 51 are preferably provided as shown in FIG. 12. At least one side interface 51, and preferably also the opposing side interface 51, are slideably moveable inwardly and outwardly relative the main body 52. The main body 52 includes a vertically extending flange 54 along one end thereof. The main body 52 defines at least one, and preferably at least two guides 55 configured for receipt of a mating member 24.

Template 50 may be provided for an indicia plate 22 having a predetermined length. Side interfaces 51 may be adjusted to accommodate indicia plates having different widths. To accommodate an indicia plate with a different length, a different template 50 may be provided. By way of example, and not being intended to be bound by any dimensions herein, for an 8½ inch length band having a width of 2 inch (plus or minus an inch), the mating members 24 (having securing members 26 secured thereto) will be positioned within the guides 55 and the indicia plate 22 will be positioned so as to abut flange 54. The side interfaces 51 will be adjusted to accommodate the plate 22. By way of example, the relevant dimensions for the guides 55 is to position the guides 55 adjacent the flange 54 approximately 1.196 inches from the flange 54 and the second guide 55 approximately 2.109 inches from the other template edge. This arrangement ensures that the mating members 24 will be properly positioned to mate with a respective alignment guide 25 within the chassis member 20. It also ensures that the desired reveal, or overhang of the plates 22 (for example, 1 inch) is uniformly achieved.

Upon assembly of the chassis assembly 12 and the indicia plates 22, the indicia plates 22 are individually positioned onto the chassis members 20 of the chassis assembly 12. Preferably beginning with the top-most indicia plate 20, the indicia plate 20 is positioned by inserting one side edge thereof over the corresponding side chassis member 20 wherein the teeth of the mating member 24 will mate with teeth of the alignment guide 25. The other side of the plate 22 will then be press fit into the opposing side chassis member 20 wherein the second mating member 24 will cooperate with the opposing alignment guide 25. Sufficient tolerances are provided wherein the application of pressured against the plate 22 (in the direction of the rear of the sign assembly 10) will secure the indicia plate 22 to the chassis member 20 due to the tolerances and configuration of the mating members 24 and the respective chassis assembly channels. The additional indicia plates 22 may be positioned onto the chassis assembly 12 in a similar fashion. Optionally, a pair of locators 45 may be positioned after the first indicia plate 22 is assembled.

To substantially minimize tampering of the sign assembly 10, the locking pin 58 may be inserted. If it is desired to alter the information displayed, the indicia plates 22 may be removed on site. This is accomplished by removing the locking pin 58 and removing a first indicia plate 22, such as the top-most plate 22. It may be necessary to access the mounting members such as the apertures 46 wherein the top indicia plate 22 or bottom indicia plate 22 may be removed. Removal of individual indicia plate 22 is accomplished by utilizing tolerances provided and urging the respective plate 22 in one direction while lifting and removing the opposing side of the plate 22. The removed indicia plate may be re-assembled as described above. Use of optional locators 45 may facilitate re-application of the indicia plates 22 to the chassis assembly 12.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A low-profile, customizable sign assembly comprising:

a first and second chassis member which extend longitudinally parallel to one another;

a support panel extending between said chassis members and said first and second chassis members define a receptacle for receipt of an alignment member wherein said alignment member comprises a mating surface which defines more than one alignment contact having predetermined distances between adjacent contacts;

at least one indicia plate for displaying information extending between said first and second chassis members;

and at least one mating member positioned on a rear side and distal portion of said at least one indicia plate and comprising a mating surface which defines a plurality of alignment contacts which are correspondingly configured to mate with said alignment member mating surface of said alignment member of at least one of said first and second chassis members for supporting said at least one indicia plate on said first and second chassis members to position said indicia plate in a predetermined position along the length of said first and second chassis members.

2. A sign assembly according to claim 1 wherein said alignment member is a longitudinally extending alignment guide.

3. A sign assembly according to claim 2 wherein said alignment member mating surface is defined by alternating tines and indentations.

4. A sign assembly according to claim 3 wherein said mating member mating surface is defined by alternating tines and indentations configured to mate with said alignment guide.

5. A sign assembly according to claim 2 wherein said alignment guide is removable from said first and second chassis members.

6. A sign assembly according to claim 2 wherein said sign assembly comprises a plurality of said alignment guides and said first and second chassis member receptacles are each configured to receive at least one of said alignment guides.

7. A sign assembly according to claim 6 wherein said first and second chassis member receptacles are each configured to receive at least two of said alignment guides.

8. A sign assembly according to claim 1 wherein said first and second chassis members define a receptacle for securing said support panel there between.

9. A sign assembly according to claim 1 comprising a pair of said mating members positioned on opposing distal portions of said at least one indicia plate for cooperating with said alignment guide in said first and second chassis members.

10. A sign assembly according to claim 1 wherein said first and second chassis member receptacles are configured for receipt of said alignment guide is a channel.

11. A sign assembly according to claim 7 wherein said first chassis member channel for receipt of said alignment guide is a distal channel and wherein said mating member comprises a distal locking flange including said mating surface on its front surface wherein said first chassis member distal channel is configured to receive said mating member locking flange and said alignment guide.

12. A sign assembly according to claim 1 wherein said mating member comprises a mating flange on a rear surface and said first chassis member defines an intermediate receptacle comprising a mating flange wherein said mating member mating flange cooperates with said intermediate receptacle mating flange to secure said indicia plate to said first chassis member.

13. A sign assembly according to claim 12 wherein said intermediate receptacle is a channel.

14. A sign assembly according to claim 1 wherein said first chassis member further comprises a medial receptacle for cooperating with said support panel, said medial receptacle comprising a securing flange for securing said support panel to said first chassis member.

15. A sign assembly according to claim 14 wherein a securing member secures said support panel to said securing flange.

16. A sign assembly according to claim 1 wherein said second chassis member receptacle for receipt of said alignment member is an intermediate channel and wherein said mating member comprises a distal locking flange including said mating surface on its front surface wherein said second chassis member intermediate channel is configured to receive said mating member locking flange and said alignment member.

17. A sign assembly according to claim 1 wherein said second chassis member comprises a medial receptacle for cooperating with said support panel, said medial receptacle comprising a securing flange for securing said support panel to said second chassis member.

18. A sign assembly according to claim 17 wherein a securing member secures said support panel to said securing flange.

19. A sign assembly according to claim 1 wherein said mating member comprises a mating flange on a rear surface and wherein said second chassis member further comprises a distal receptacle comprising a mating flange wherein said mating member mating flange cooperates with said intermediate receptacle mating flange so secure said indicia plate to said second chassis member.

20. A sign assembly according to claim 19 wherein said second chassis distal receptacle further comprises a tamper resistant member for preventing lateral movement of said indicia plate when positioned on said second chassis member.

21. A sign assembly according to claim 20 wherein said tamper resistant member is a locking pin and said distal receptacle is a distal channel wherein said locking pin extends longitudinally within said distal channel.

22. A sign assembly according to claim 1 wherein said indicia plate has a width measured between distal edges thereof and said width extends outwardly from side edges of said first and second chassis members.

23. A sign assembly according to claim 11 wherein said first chassis member distal receptacle further defines a bendable locking flange for securing said alignment guide within said distal channel.

24. A sign assembly according to claim 16 wherein said second chassis member intermediate receptacle further defines a bendable locking flange for securing said alignment guide within said distal channel.

25. A sign assembly according to claim 1 further comprising a second indicia plate having at least one of said mating members on a distal end thereof and said alignment member extends substantially the length of said first and second indicia plates wherein said indicia plates are positioned along the length of said first and second chassis members wherein said second indicia plate is properly aligned with said first indicia plate.

26. A sign assembly according to claim 25 wherein said mating member comprises a horizontally and outwardly extending flange on its front surface which is configured to cooperate with a bottom edge of said indicia plate.

27. A sign assembly according to claim 1 further comprising a mating member positioning template for positioning said mating member to a rear surface of said indicia plate, said template comprising a main body and a pair of opposing side interfaces wherein at least one of said side interfaces is slideably connected to said main body.

28. A method of displaying customizable information in a sign assembly having a first and second side chassis members each defining a receptacle and a support panel extending between the chassis members and at least one indicia plate for displaying customizable information comprising the steps of:

positioning at least one alignment guide in each of said chassis member receptacles wherein the alignment guide has a mating surface defining predetermined positions;

mounting a mating member to a distal end of a rear surface of said indicia plate wherein the mating member has a mating surface defining predetermined positions;

applying the indicia plate mating member within said second receptacle of the first of said first chassis member and engaging said mating member mating surface with said alignment guide mating surface to horizontally positioned said indicia plate in said predetermined position; and engaging the second distal end of said indicia plate to the second chassis member.

29. A method according to claim 28 further comprising the step of mounting a second mating member to the opposite rear distal end of said at least one indicia plate and said step of engaging the second distal end to the chassis member includes engaging said second mating member with the alignment guide mating surface of the second chassis member.

30. A method according to claim 28 further comprising the step of applying a second indicia plate to said chassis member by mounting a mating member to a distal end of a rear surface of said indicia plate wherein the mating member has a mating surface defining predetermined positions;

applying the indicia plate mating member within said second receptacle of the first of said first chassis member and engaging said mating member mating surface with said alignment guide mating surface to horizontally positioned said indicia plate in said predetermined position;

engaging the second distal end of said indicia plate to the second chassis member; and mounting a second mating member to the opposite rear distal end of said at least one indicia plate and said step of engaging the second distal end to the chassis member includes engaging said second mating member with the alignment guide mating surface of the second chassis member.

31. A method according to claim 28 further comprising the step of positioning a plurality of said alignment guides within said receptacle of said side chassis members.

32. A method according to claim 31 comprising the further step of securing the alignment guides by depressing a securing flange defined by said second receptacle of the chassis members.

33. A method according to claims 28 further comprising the step of positioning a locator having a flange wherein said flange cooperates with the alignment guide of the first chassis member and an outwardly extending horizontal flange which cooperates with a lower edge of said indicia plate.

34. A method according to claim 30 wherein said step of mounting a mating member to the indicia plate comprises the step of positioning the mating member into a template to positioned the mating member in a proper position of the indicia plate.

35. A method according to claim 28 further comprising the step of providing tamper resistant means to prevent unintentional removal of said indicia plate.

36. A method according to claim 35 wherein said step of providing tamper resistant means includes inserting a locking pin into the first or second chassis member.

37. A method according to claim 28 further comprising the step of positioning a rear member within a medial receptacle of the first and second side chassis members.

38. A low-profile, customizable sign assembly comprising:

a first and second chassis member which extend longitudinally parallel to one another;

a support panel extending between said chassis members and said first and second chassis members define a receptacle for receipt of an alignment member wherein said alignment member comprises a mating surface which defines more than one alignment contact having predetermined distances between adjacent contacts;

at least one indicia plate for displaying information extending between said first and second chassis members;

and at least one mating member positioned on a distal portion of said at least one indicia plate and comprising a mating surface which defines a plurality of alignment contacts which are correspondingly configured to mate with said alignment member mating surface of said alignment member of at least one of said first and second chassis members for supporting said at least one indicia plate on said first and second chassis members to position said indicia plate in a predetermined position along the length of said first and second chassis members and wherein said indicia plate has a width measured between distal edges thereof when mated with said first and second chassis member and said width extends outwardly from side edges of said first and second chassis members.

39. A low-profile, customizable sign assembly comprising:

a first and second chassis member which extend longitudinally parallel to one another;

a support panel extending between said chassis members and said first and second chassis members define a receptacle for receipt of an alignment member wherein said alignment member comprises a mating surface which defines more than one alignment contact having predetermined distances between adjacent contacts;

at least one indicia plate for displaying information extending between said first and second chassis members;

and at least one mating member positioned on a distal portion of said at least one indicia plate and comprising a mating surface which defines a plurality of alignment contacts which are correspondingly configured to mate with said alignment member mating surface of said alignment member of at least one of said first and second chassis members for supporting said at least one indicia plate on said first and second chassis members to position said indicia plate in a predetermined position along the length of said first and second chassis members and wherein said mating member comprises a mating flange on a rear surface and said first chassis member defines an intermediate receptacle comprising a mating flange wherein said mating member mating flange cooperates with said intermediate receptacle mating flange to secure said indicia plate to said first chassis member.

* * * * *